United States Patent [19]

Thomas

[11] 4,359,827

[45] Nov. 23, 1982

[54] HIGH SPEED PAPER DRYING

[75] Inventor: Keith V. Thomas, Tacoma, Wash.

[73] Assignee: Weyerhaeuser Company, Tacoma, Wash.

[21] Appl. No.: 234,288

[22] Filed: Feb. 17, 1981

Related U.S. Application Data

[63] Continuation-in-part of Ser. No. 91,684, Nov. 5, 1979, abandoned.

[51] Int. Cl.[3] ..... F26B 3/24

[52] U.S. Cl. ..... 34/16; 34/23; 34/114; 34/116

[58] Field of Search ..... 34/54, 15, 16, 41, 114, 34/115, 116, 117, 122, 123, 23; 68/5 C, 5 D, 5 E

[56] References Cited

U.S. PATENT DOCUMENTS

| | | | |
|---|---|---|---|
| 3,237,316 | 3/1966 | Sachs | 34/115 |
| 3,816,941 | 6/1974 | Holik et al. | 34/116 |
| 3,874,997 | 4/1975 | Kankaanpaa | 34/116 |

OTHER PUBLICATIONS

Article by D. A. Ely, "A Look at Papermaking Concepts for the Future", Paper Age, Apr. 1981; pp. 38-40+2 pp. drawings.

*Primary Examiner*—Larry I. Schwartz
*Attorney, Agent, or Firm*—Weyerhaeuser Company

[57] ABSTRACT

An improved paper drying process and machine are described in which the paper web is supported independently of velocity-induced stresses thus permitting operation at speeds significantly in excess of the prior art for each paper grade. The process requires: (1) transporting the web on a supporting fabric that travels from the last press nip through at least the initial portion of a drying section; and (2) holding the web onto its supporting fabric by employing forces normal to the major web surfaces sufficient to overcome those forces which tend to lift the web from its supporting fabric. The web on its supporting fabric travels a serpentine path through the drying section about drying cylinders with the web alternating between direct contact with a drying cylinder followed by indirect contact with the subsequent cylinder. The principal holding forces are preferably pressure differentials created by vacuum boxes arranged to effectively hold the web to its supporting fabric on all portions of the web-fabric combination where the web is not in direct wrapping contact with the drying cylinders. The fabric supports the web at least until the web has attained sufficient strength through increased dryness to resist breaking stresses at the selected machine speed. The products made by the process of this invention possess a unique toughness or stretchability not found in conventionally prepared papers that have been strained or stretched during manufacture. Processes and machine arrangements designed to balance stretchability with certain desirable stiffness properties are disclosed. Pulp furnishes may now be selected for their contribution to product qualities, such as higher finished product tensile strength, rather than principally for wet strength. For example, chemical pulps may be significantly reduced or eliminated from newsprint furnishes where their purpose has been principally to permit economic paper machine speeds. The invention makes attainable speeds approaching twice current operating levels for each paper grade.

15 Claims, 7 Drawing Figures

Fig. 5
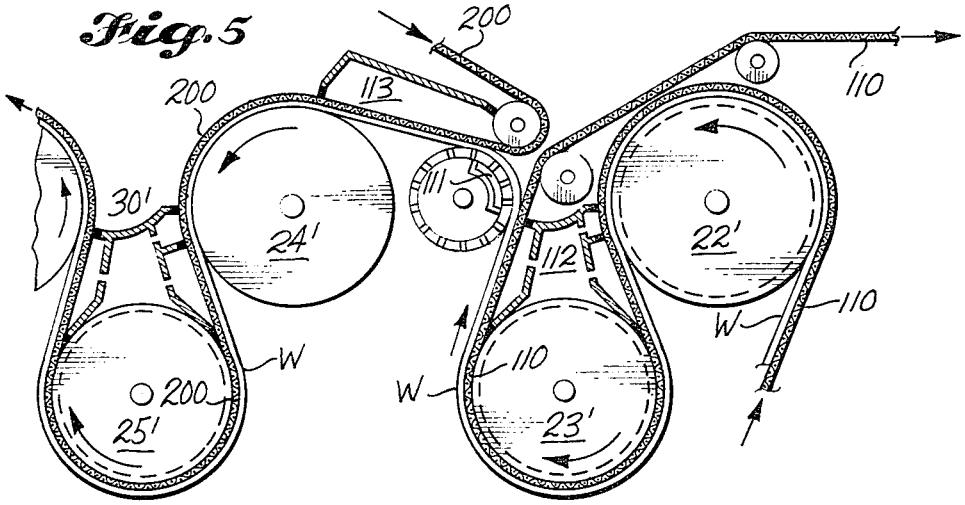
Fig. 6
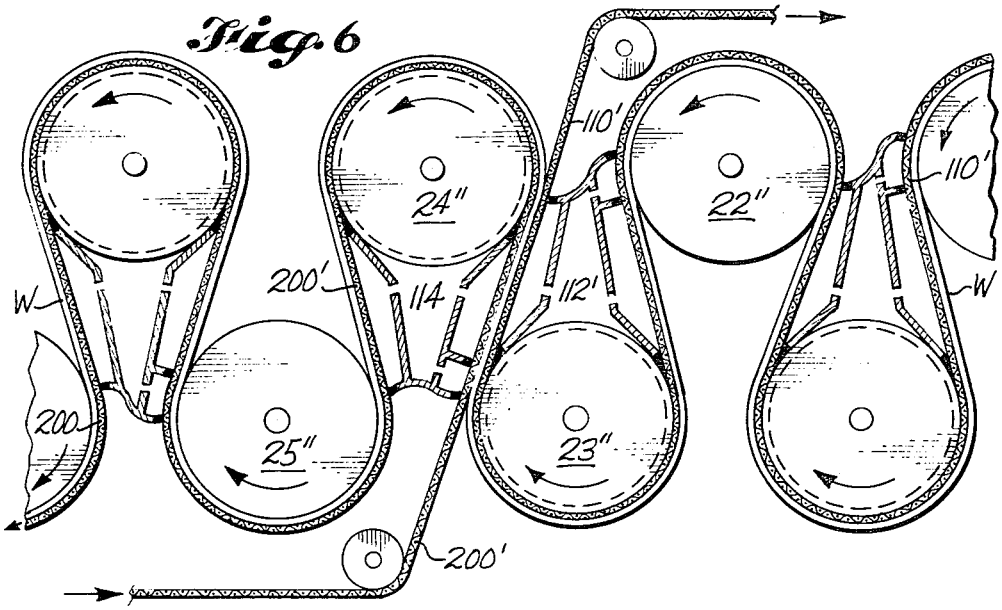
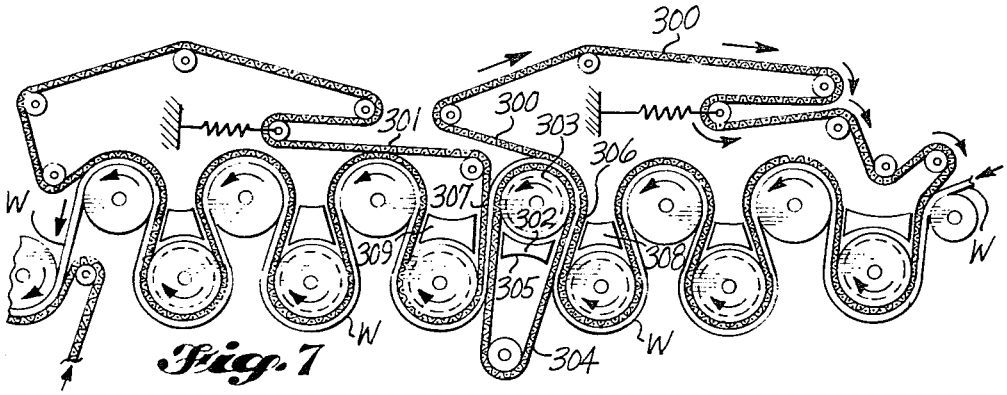
Fig. 7

HIGH SPEED PAPER DRYING

This is a continuation-in-part of application Ser. No. 091,684, filed Nov. 5, 1979 now abandoned.

BACKGROUND OF THE INVENTION

1. Field of the Invention

This invention relates to paper machine productivity and means for attaining machine speeds significantly in excess of the prior art. The invention is concerned with eliminating stresses that act on the wet paper sheet as the web travels through the drying portions of the paper machine.

2. Prior Art

In papermaking, after sheet formation, the paper web, supported on one of a series of porous felts, passes through a series of press nips that mechanically express water from the sheet. The wet web at about 35–45% fiber content is then contacted with a series of heated drums or cylinders that evaporate water from the web to a finished dryness of about 90–95%. The web is, conventionally, unsupported at many points in the process as it travels through the later press nips and between the heated drums in the dryer section.

Machines that are not forming or drying limited are run at increasing speeds to gain production. A practical limit is always reached where increased productivity expected by further increases in speed is nullified by increased production losses due to sheet breakages and product defects. For example, newsprint machines appear to be limited to about 3,500 ft./min. (1070 m/min.) by current technology. This practical machine speed limit differs for each paper grade such as newsprint, liner, medium or fine paper. Further, within each grade of paper, the speed limit differs for differing basis weights.

Observations of operating paper machines show that, as speed increases, breaks in the web generally occur at those points in the process where the web is: (a) transported unsupported through the process while relatively wet and weak, such as occurs in transferring the web from the press to the drying section and between drying section rolls or cylinders, or; (b) required to change direction quickly while in adhesive attachment to a supporting element, such as occurs when the web is picked up by a felt from the forming wire.

When the speed of the machine is held constant, breakages increase with decreased paper basis weights within each grade. These breakages occur where the web is transferred from one machine element to another by pulling or peeling the web from the element to which it is adhered, such as occurs at transfers from forming wires to press felts and from press rolls to dryer sections.

For further discussion regarding press section stresses and pressure differential means, see U.S. patent applications Ser. No. 091,212 now abandoned filed Nov. 5, 1979 and Ser. No. 091,211 now abandoned filed Nov. 5, 1979, now continuation-in-part Ser. No. 625,313 now U.S. Pat. No. 3,986,996, both authored by Keith Thomas of Weyerhaeuser Company, and incorporated herein by reference.

Edge "flutter" in the dryer section may also be observed. Flutter tends to cause edge "stretch," resulting in wrinkling defects in the finished product. Differential stretching at the web edges also imparts instability or "curl" to the finished paper.

It is well known that, as a paper web passes through the dewatering and drying process on the paper machine, it, in general, gradually develops strength with increased dryness. Practicalities determine that the overall speed of the paper machine be limited to make sure that stresses in the web do not approach, at any point, too closely to the paper web's breaking strength. Without a more detailed knowledge of the strength of the web and the stresses operating on it as it passes through the machine papermakers have, in the past, attempted to avoid in an empirical way the increased sheet breakages observed with increased speed and decreasing paper weights.

These efforts include press and dryer section designs where the wet web travels with a porous felt or fabric during transit through at least a portion of either section.

Mahoney, in U.S. Pat. No. 3,503,139, provides a fabric intended to support the wet sheet throughout its serpentine travel from drum to drum in the dryer section. What actually happens as machine speeds increase is that the web is lifted and separated from its supporting fabric, particularly at points where the web approaches and departs drying cylinders. The lifting forces are centrifugal forces exerted on the web at certain locations in the machine and air currents caused by the turning drums and moving belts in the dryer section. These forces are generally non-critical in conventional systems only because these systems operate at low speeds. At higher machine speeds, however, these stresses increase in magnitude to cause breakages. Whenever the web is lifted from its supporting fabric, it is subjected to velocity stresses as if the fabric were not present.

It should be noted that the Mahoney web, as is typical of the prior art, is totally unsupported at the transfer from the press section to the first dryer cylinder. Thus, at this transfer, in addition to peeling stresses, the web is also subject to the velocity-related stresses noted.

In Mahoney, the web is, alternatively, partially wrapped in direct contact with one drum followed by indirect contact with the next drum. Mahoney compensates for the loss in heating effectiveness occasioned by the indirect contact of the web with the heated drum surfaces on alternate drums by operating those drums at higher temperatures.

In an improvement over Mahoney, Soininen et al., in U.S. Pat. No. 3,868,780, adds a number of rolls to the Mahoney system to guide the web into direct contact with each of the heated drums during transit of the web through the dryer section. In recognition of the increased likelihood of "flutter" separating the web from its support on the longer runs between dryer drums, the Soininen guide rolls operate under vacuum that adheres the web to their supporting surfaces. There is also an overall vacuum system to help hold the web onto supporting fabrics.

The Soininen system has a number of operating impracticalities. The guide rolls tend to cause a relatively large differential movement between the tender web and the fabric, resulting in "scuffing" damage to the web. The complexity of the system and extra components required introduce substantial capital costs. Operating costs are high because of the power required to drive the extra components and also since cleanout of paper after breakages appears to be difficult. Heat applied to only one side of the sheet, as in Soininen, results in paper products having different characteristics for each surface. These differences can cause printing non-uniformities when both sides must be printed.

In sum, the prior attempts to improve paper machine productivity by increasing machine speeds have generally failed because their designers have, up until now, had only an imperfect understanding of where in the papermaking process stresses operating on the moving sheet become critical and limit speed. Also lacking has been an understanding of how paper machine conditions, such as those affecting sheet temperature, for example, affect the ability of the sheet to resist velocity stresses.

SUMMARY OF THE INVENTION

A principal object of the papermaking processes and machines of this invention is to reduce and, to the extent possible, eliminate or control those stresses ordinarily operating on the wet web in the drying sections of the paper machine that are a function of velocity of the sheet and which limit machine speed. These stresses limit production speeds because of the threat of downtime occasioned by sheet breakages and product quality defects which papermakers expect as speed is increased.

It is an object of the invention to present a suitable paper machine equipment design that at reasonable capital cost accomplishes the elimination or control of velocity stresses. The new machine design employs familiar papermaking equipment thus permitting back fitting of existing machines. These improvements permit substantial reduction of pulp furnish costs or operation of the dryer section significantly in excess of prior art speeds for any particular grade.

A paper furnish may now include a lesser amount of expensive stronger pulps, such as chemical pulp in newsprint grades, that heretofore have been added to the furnish largely to increase the speed rates at which the machine will operate effectively. The paper furnish may now be selected more for its impact on the finished paper product rather than to meet a processing requirement for wet strength early in the drying section. While some newsprint machines, for example, operate without chemical pulps as components of their furnish, they do so at much lower machine speeds than those operating at state of the art speeds where chemical pulps may constitute in excess of 35% of the furnish.

The objects of this invention in eliminating velocity stress are accomplished by the process of: (1) transporting the web on a supporting means from the last press nip through at least a first portion of the drum or cylinder dryer section of the paper machine until the paper web has attained sufficient strength to be self-supporting at a given machine speed through increased dryness; and (2) holding the web onto the supporting fabric means by employing forces normal to the major web surfaces sufficient to overcome velocity-related stresses on all portions of the web during transporting at least until the web has attained sufficient strength to be self-supporting at the selected machine speed.

In the process of this invention at least a portion of the holding forces is created by a pressure differential forcing the web against its supporting means. The pressure differential means operate effectively in holding the web to its supporting means along substantially the entire length of travel of the web between dryer cylinders through at least a first portion of the series of dryer cylinders.

Each paper product produced by following the process of this invention possesses unique characteristics resulting from the reduced tensile or machine direction stress it experiences during its transit from the last press nip through the first portion of the dryer section. Reduction of stress results in finished paper products having retained "stretch," extensibility or toughness that is typically stressed out of conventional papers.

The paper machine invention is a modification of the conventional machine design which typically consists of a series of press nips followed by a series of heated dryer cylinders or rolls.

The machine improvement comprises: (1) a fabric means that receives the wet web from the last press nip and transports the web through the process until the web, through increased drying, has attained sufficient strength to be self-supporting at the selected machine speed; and (2) means for applying forces normal to the major web surfaces for holding the wet paper web onto its supporting fabric wherever the web would otherwise be subjected to the above-noted velocity stresses.

The drying cylinders are arranged in a double row series. The web, supported on its fabric, is transported in a serpentine manner throughout the dryer section, partially wrapping each cylinder. The wet web is sequentially carried: into direct wrapping contact with a rotating heated cylinder surface; between the heated cylinder to a next heated cylinder; into indirect wrapping contact with that following cylinder, with the fabric in direct wrapping contact with its surface; and, between the indirect wrapped cylinder and a next heated cylinder in the sequence. This pattern is repeated at least until the web is dried to self-supporting strength, relative to machine speed.

A portion of the holding means of the invention comprises a series of pressure differential zones adjacent to the path of the fabric. The zones extend adjacent to the web-supporting fabric substantially along its path wherever it is not in either direct or indirect contact with a cylinder surface. A differential pressure means operating on the zones forces the web against the fabric.

The holding means may comprise vacuum boxes, preferably positioned adjacent to those dryer cylinders about which the fabric is interposed between the web and the surface of the cylinder. The vacuum box defines pressure differential zones adjacent to the surface of the fabric opposite the surface of the fabric in contact with the wet web.

A process and machine of this invention for controlling the amount of shrinkage permitted in a paper web in the drying section to preserve stretchability while permitting a certain amount of strain to be exerted on the web to improve stiffness for curl resistance are described.

This process involves drying the web on a first fabric wrapping a first group of drying cylinders, pressure differential means holding the web on its supporting fabric as the web travels from drying cylinder to cylinder and about said cylinders, followed by drying the web on a second fabric wrapping a second group of drying cylinders arranged similarly to the first group. The second group of drying cylinders operates at a rotational peripheral velocity less than that of the first group of drying cylinders, the speed being selected to attain desired shrinkage and stiffness. The web is transferred from the first fabric onto the second fabric by pressure differential means acting on the web to effect transfer without subjecting said web to peeling or velocity stresses.

Three preferred arrangements and means are shown for accomplishing the transferring step. The first scheme involves transferring the web from the first fabric onto a transfer roll or cylinder by means of its pressure differential surface means. The transfer roll brings the web into contact with the second supporting dryer fabric, which is subject to a pressure differential means which is of sufficient strength to transfer the web from the transfer roll surface onto the second dryer fabric for continuing through the drying process.

A second transferring process requires converging the web supported on the first fabric and subject to a first pressure differential means into contact with the second supporting fabric subject to a second pressure differential means. The web is momentarily sandwiched between the first and second fabrics with the second differential means exerting a normal force on the web sufficient to transfer the web from the first fabric onto the second fabric.

A third transferring process is a combination of the first two with the transfer roll being wrapped with a transfer fabric. The web is transferred by pressure differential means from the first fabric onto a transfer fabric. The transfer fabric traveling about the transfer roll converges the web into contact with the second fabric. A pressure differential means acting on the second faric effects transfer of the web, momentarily sandwiched between the second fabric and the transfer fabric, from the transfer fabric onto the second fabric.

BRIEF DESCRIPTION OF THE DRAWINGS

FIG. 5 is a supported transfer of the web between fabrics in the dryer section.

FIG. 6 is an alternative method of the transfer shown in FIG. 4.

FIG. 7 is yet another transfer means.

DESCRIPTION OF THE PREFERRED EMBODIMENTS

1. Inherent Strength of the Paper Web

Paper web strength, first of all, is a function of the paper furnish being processed. This property is a function of the species of wood making up the fibers. For example, papers made of softwood fibers, such as Douglas fir, are stronger than paper made of hardwood fibers, such as alder. Strength is also a function of the pulping process used in separating the fibers from the wood raw material. For identical wood species, groundwood, for example, is known to have an appreciably lower strength at a given moisture content than chemical pulps made by the sulfite or kraft process.

For any pulp furnish, the strength of a paper sheet is primarily a function of its moisture content. Lyne and Gallay, "Measurement of Wet Web Strength" Tappi Vol. 37, No. 12, (December 1954). The ability of a paper web to resist stresses without breaking at any point in the papermaking process is, therefore, principally related to its moisture content.

In general, the moisture content of the paper web decreases as it passes through the papermaking process, with the strength of the paper web increasing as the web increases in dryness. However, there is a marked interruption in strength gain as the web is passing through the early drum drying stages.

Strength actually decreases on the first few dryer drums, after transfer from the last press nip, as the web experiences a rapid increase in temperature. At this stage, the temperature of the web is approaching the boiling point of the moisture present.

This not previously recognized and quantified strength reduction is a temperature phenomenon. The phenomenon has remained obscured perhaps because strength testing, including the work conducted by Lyne and Gallay cited above, has been done at 70° F. (21.1° C.) as a matter of standardized testing procedure to permit comparisons between pulps. The temperature effect on testing has thus been known but the significance of the degree to which the actual strength of the sheet in the process is effected by processing temperature has escaped the attention of papermakers.

Figure 1:
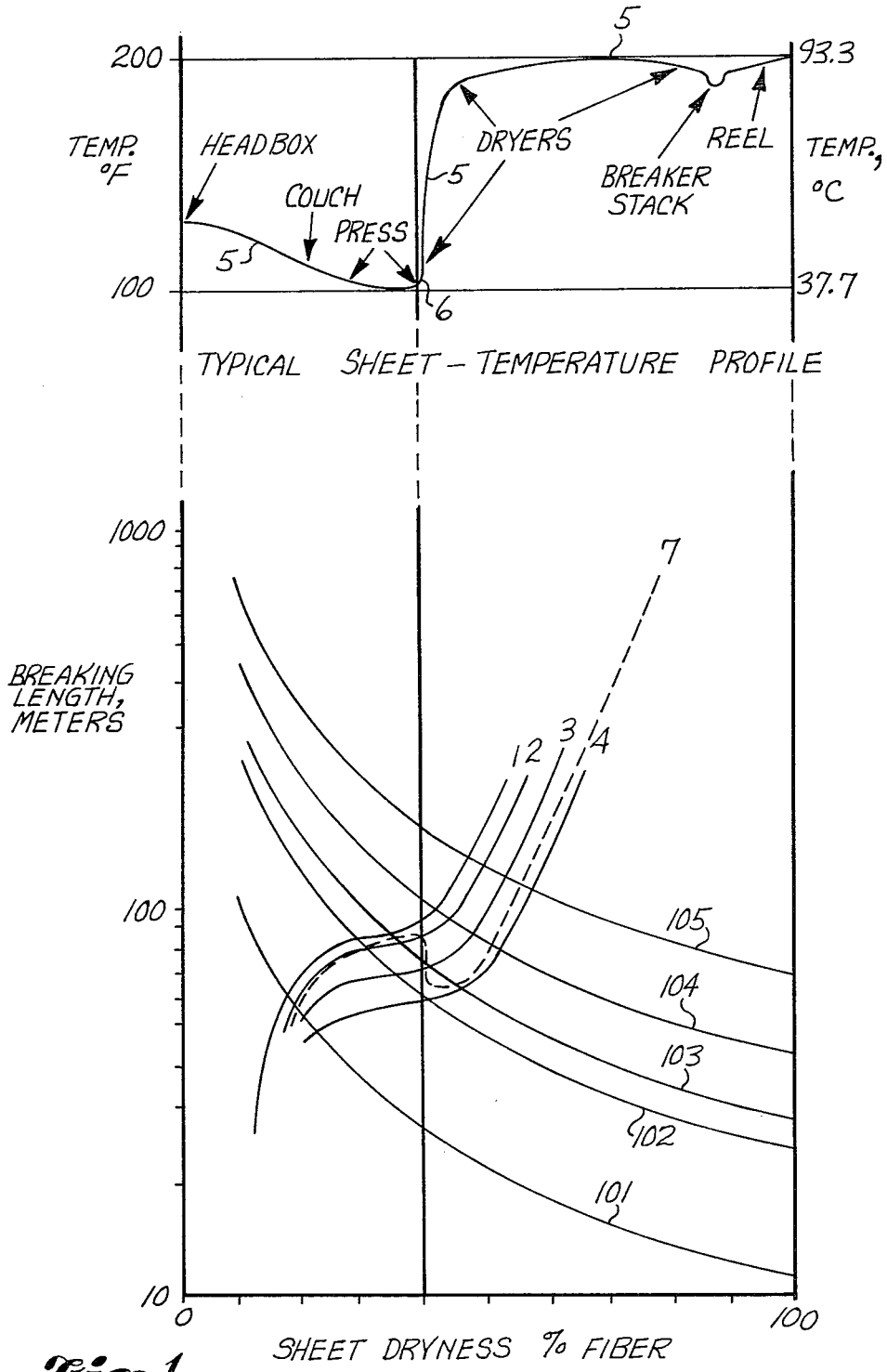
FIG. 1 illustrates paper web strength as a function of sheet dryness, temperature of the web as the web progresses through the paper machine, and stress on the web as a function of velocity.

Referring to FIG. 1, the significant decrease in sheet strength resulting from increasing temperature for a typical newsprint furnish is shown. The family of curves 1, 2, 3 and 4 shows the temperature effect on strength for a newsprint furnish. The curves are for 70°, 100°, 150° and 200° F. (21.1, 37.7, 65.6, and 93.5° C.,) respectively. The data used in plotting FIG. 1 where derived from samples of a newsprint, comprising a combination of groundwood and chemical pulp.

In FIG. 1, paper web strength, in terms of "breaking length" is shown as a function of "sheet dryness", in weight percent fiber. Breaking length, expressed in meters, is the length of a strip of paper which would break of its own weight if suspended vertically. Breaking length is related to tensile strength which is the force, parallel with the plane of the paper, required to produce failure of a specimen of specified width and length under specified conditions of loading.

Curve 5 shows sheet temperature as the sheet proceeds through the papermaking process on a typical machine. The temperature of the sheet remains relatively unchanged from the head box through the last press nip, indicated at point 6, on curve 5. As the web contacts the first few dryer drums, the temperature rises extremely rapidly. Thereafter the temperature remains relatively constant as drying continues.

The strength of the newsprint paper sheet as it passes through the machine is shown by dashed curve 7. There is an increase in strength initially as the sheet is dewatered on the forming wire. There is a relatively lower rate of increase through the press section. A substantial decrease in strength follows as the web contacts the first several drum dryers where the water and web are heated with little change in dryness. While some water is driven off, the drying effect is more than offset by a decrease in web strength due to the temperature effect, previously demonstrated by curves 1–4, resulting in a significant net decrease in strength. Thus the discontinuity in increasing strength as the sheet increases in dryness, at the first few drums in the dryer section, is the result of the sudden increase in temperature of the web.

Curve 7 of FIG. 1, a composite of the strength curves 1–4 and process temperature curves, shows the strength of the sheet of the particular newsprint furnish examined, as a function of dryness and temperature, as it travels through the papermaking process. If velocity stresses, for example, exceed the strength of the sheet, related to the dryness, temperature and paper furnish, sheet breakage will occur.

2. Identification and Elimination of Productivity Limiting Stresses

Prior art paper machine operating speeds are limited or bottlenecked by web breakages of the weak, wet fiber web. As previously noted, the critical stress points in the process, observed most frequently, are:

(a) where the web experiences large angular changes;

(b) where the web is allowed to run unsupported and is thus subjected to velocity stresses; and (c) where the web is pulled or peeled from a machine element to which the web is adhered, e.g., a press roll.

The relationship between velocity and the ability of a web, made of a given material, to survive without breaking, as the machine speed is increased can be analyzed mathematically. The quantified results are confirmed by actual observations of the critical locations in the process.

Inspection of the paper sheet as it passes unsupported through the conventional paper machine shows that the paper web does not travel without a certain amount of slack building up in the web, particularly as it travels between drying cylinders. This is so because only a limited tension can be exerted on a relatively weak paper web in pulling or "drawing" it through the process without causing a breakage. Bulges and series of standing waves tend to build up in the slack web, their form or frequency dependent upon sheet velocity, the distance the web travels unsupported and air currents generated by operating machinery.

The forces exerted on the web as it moves through a standing wave, as described above, or about a roll may be viewed in terms of conventional centrifugal force analysis. The minimum loads or stresses parallel with the plane of the paper that a fiber paper web experiences as it travels through the machine can then be calculated in terms of tensile stress.

For an element of a dry paper web, the tensile stress due to the centrifugal forces exerted on the web as it passes through, for example, a standing wave, generally circular or sinusoidal in profile, may be expressed as:

$$T_s = \frac{\sigma v^2}{g}$$

where $T_s$=tensile stress=the tensile force in the sheet resisting centrifugal forces acting on the element per unit thickness of the sheet, v=liner speed of the sheet, g=gravitational acceleration, and $\sigma$=density of the sheet=basis weight÷thickness of the sheet, wherein basis weight is the weight of fiber in a standard area of paper. The tensile stress, $T_s$, can be expresed in terms of "equivalent breaking length" ($EBL_v$) as follows:

$$T_s = EBL_v \times \sigma$$

$$\therefore EBL_v = \frac{v^2}{g}$$

This expression is based on dry density. For wet webs, a dryness factor, d=(100/% dryness,) must be introduced.

Thus $$EBL_v = \frac{v^2}{gd}$$

This analysis shows that web stresses $T_s$ and $EBL_v$ are independent of the radius traveled by the sheet, its basis weight and its dry density. These stresses are inversely proportional to sheet dryness and constant for any velocity and dryness.

Referring to FIG. 1, curves 101, 102, 103, 104 and 105 show velocity stress expressed as equivalent breaking lengths versus dryness for machine speeds of 2,000, 3,000, 3,300, 4,000 and 5,000 ft./min. (610, 915, 1006, 1220 and 1525 m/min.), respectively. The curves show the minimum strength the web must have in order to travel unsupported at the selected speed.

These calculated stresses are minimum stress loads because generally there are additional stresses caused by local flapping or fluttering, both longitudinal and cross machine, particularly at the edges of the web. Air currents, generated by the rapidly turing rolls, fabrics and other machinery, typically cause these stresses on the moving sheet.

Stresses calculated by the above analysis are valid even for those cases where prior workers have attempted to support the paper web on a fabric or felt as, for example, Mahoney, cited above. This is so because air currents tend to penetrate a porous fabric and "bulge" or lift the paper sheet from its supporting contact with the fabric. These bulges cause the web to be subjected to the above-described velocity stresses. Also, on those dryer rolls where the fabric directly wraps the drum with the web on the outside, the web tends to separate from the fabric under the centrifugal stresses resulting from passing about the rotating roll. In situations suh as Soininen, et al., cited above, describes, the web leaving the last press nip adheres to the solid press roll and must be peeled therefrom. In the gap between the surface of the press roll and initial contact with a supporting fabric, the web is unsupported and thus subjected to web breaking velocity stresses.

A conclusion to be drawn from the analysis of the velocity stresses acting on the web is: the web web must be transported on a supporting means wherever it would be, if not supported, subjected to speed related stresses that are likely to exceed the breaking strength of the web. FIG. 1 indicates, for a particular paper, that the web must be supported whenever "breaking length" stresses, for example the velocity stress levels indicated by curves 101–105, are above the strength curve 7 levels at any point in the process.

Analysis of the failure of past attempts at supporting the web leads to a further conclusion that a means must be provided to ensure that the paper web is held onto its supporting means, in order for the web to remain independent of the velocity forces that tend to act on the separated web. Failure to recognize this need for a means to hold the web onto its supporting fabric characterizes, in general, the prior art designs.

It has long been the experience of papermakers that the productivity of a paper machine is reduced when there is a significant reduction in the basis weight of the grade being manufactured. This production rate penalty is accepted because lightweight papers often command a price premium in the market. Machines making lightweight paper grades are conventionally of the type that utilize a single felt in the last press nip, pressing the web against a smooth hard-surfaced roll. The sheet adheres to these rolls requiring a peeling or tensile stress to be exerted on the web to pull the web free of the roll surface.

The forces in the sheet required to pull it from a press roll have been defined by Mardon and others. See Mardon, "The Release of Wet Paper Webs from Various Papermaking Surfaces," APPITA Vol. 15, No. 1 (July 1961). Peeling stress is the primary speed-limiting factor in conventional paper machines when basis weights are reduced, aside from velocity stress considerations. The peeling force per inch of width required to remove the web from a smooth press roll is independent of the sheet weight. However, reducing the basis weight by reducing the thickness of the sheet increases the peeling stress experienced by the sheet. If the basis weight is reduced by one-half, the stress exerted in the web is doubled. Peeling stresses are discussed in more detail in the above-identifed concurrently filed U.S. application, Ser. No. 091,212.

Other factors affect the operating speed of a given machine, including limitations imposed by forming, pressing, drying and sheet treatments such as coating, sizing, calendering and the like. Factors other than those imposing stresses on the sheet during pressing and drying are outside the scope of the invention and, for discussion, are assumed to be met by the strength of the sheet. In other words, the prior art machine is speed limited by the velocity stresses imposed on the sheet where it is unsupported in the press and dryer sections.

3. Detailed Description of the Invention

The above analysis clarifies the velocity stress, peeling stress and basis weight interactions which place speed and paper furnish restrictions on the prior art processes and machines. Generally, the velocity stresses are speed limiting for heavier weight sheets. These stresss have been shown earlier to be independent of the basis weight. As basis weight is reduced, peeling stresses increases until they become the predominant speed limitating factor.

The elements of this invention eliminate velocity stresses which currently limit machine speeds and productivity. Thus, a major advantage of the present invention is that since the papermaking process is made independent of velocity stresses the machine may be run at speeds limited only by drying rates, assuming peeling stresses are insignificant or controlled. Additionally, weaker furnishes may be substituted for expensive chemical pulps.

Figure 2:
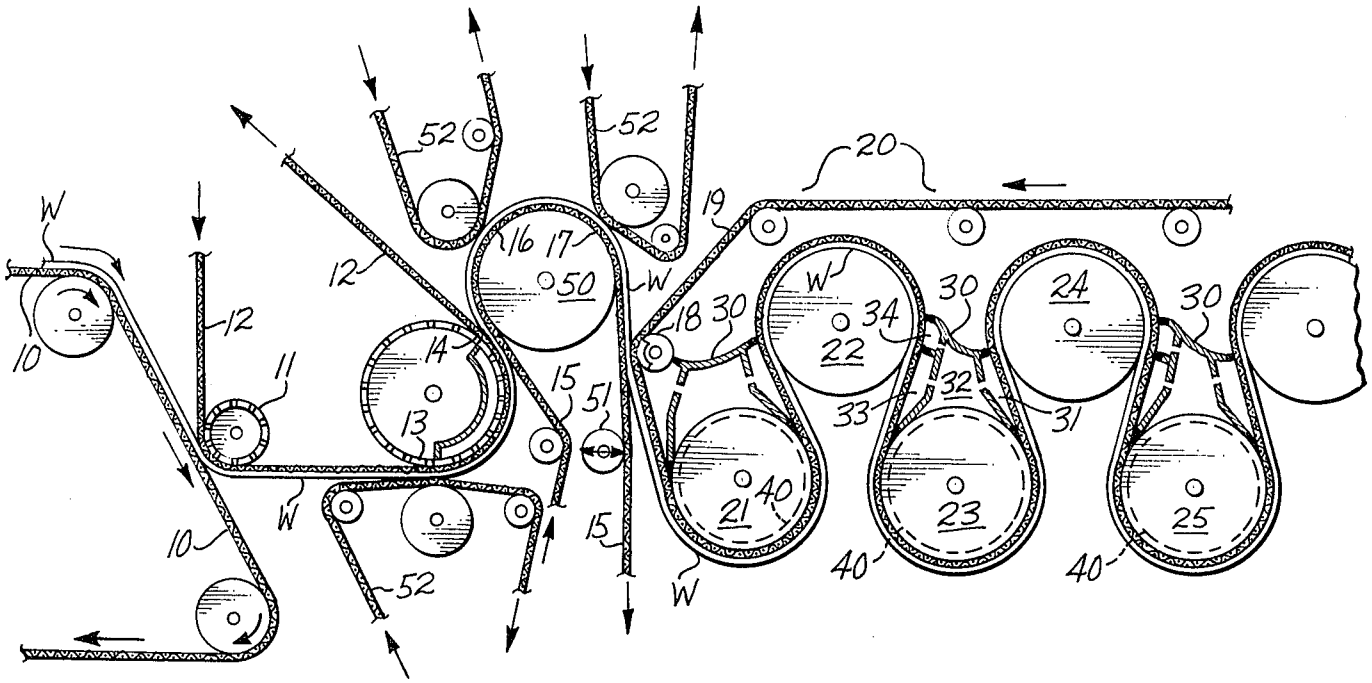
FIG. 2 is a schematic elevation view showing a papermaking process and machine of this invention.
Figure 3:
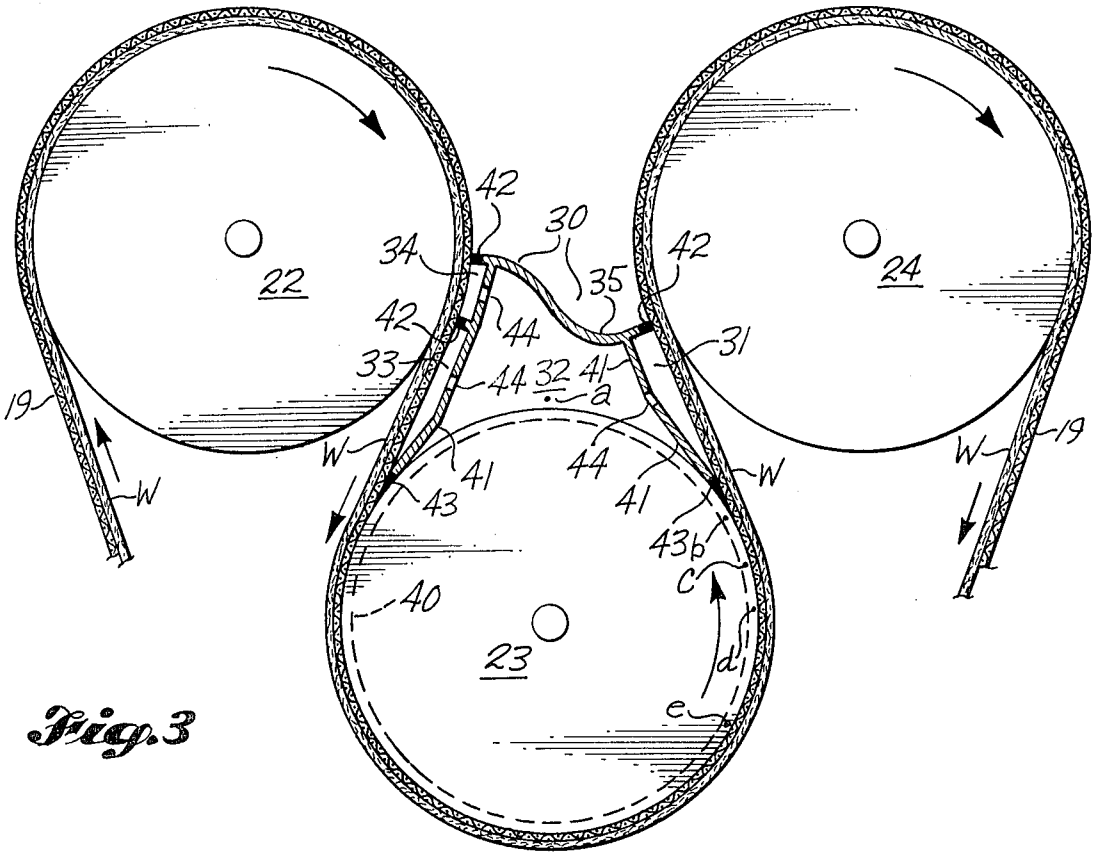
FIG. 3 is a side elevation view of the drying cylinder arrangement of this invention, including a vacuum box holding means.

Referring now to FIGS. 2 and 3, a preferred embodiment of the invention is shown. Paper web W is formed on wire 10. Pick-up roll 11 transfers the web onto press felt 12. The web W progresses, supported on the felt 12, through the first two press nips 13, 14. The web W is transferred to a belt 15 at the nip 14 for subsequent travel through the last two nips 16, 17 of the press section. Felts 52 carry away water absorbed from the web at the nips 13, 16 and 17. After the last pressing nip 17, transfer roll 18, with directional roll 51 in cooperation, effects a transfer of the web W from the belt 15 onto the dryer section fabric 19 for transport through the dryer section 20.

The web travels on fabric 19 thereafter in a serpentine path through the dryer section 20 about each of the dryer drums successively. The web is in indirect wrapping contact with the initial drum 21, with the fabric in direct contact with the heated surface of the drum. The web is then transported into direct heat transfer contact with the upper drum 22. Thereafter the web is transported into indirect or direct contact with the cylinders in sequence through the dryer system.

The characteristics of the web and machine conditions determine what holding forces adhere the web to its supporting means during transit through the machine. The sheet leaving the forming wire 10 is wet and adheres well to the pickup press felt 12 and press belt 15. Adherence of the web to the press belt 15, independent of velocity stresss, depends upon belt characteristics, such as low permeability and porosity, more fully discussed in the above-identified concurrently filed applications. The sheet after the press section will not, in general, adhere to the typical dryer fabric 19; in part, because the sheet, in passing through the dryer, becomes drier and more permeable, and; in part, because the dryer fabric 19 is much more permeable than press felts 12 and press belt 15. Adherence forces, dependent upon surface tension forces between the web and a fabric become weaker and weaker and eventually ineffective as the web and fabric become drier and more permeable.

Referring to FIGS. 2 and 3, a preferred means for applying pressure differential holding forces to the web to positively hold it to its supporting fabric 19 comprises a contoured vacuum box 30 (vacuum source not shown). The vacuum box 30, in general, fills dryer section "pockets" existing between cylinder rows and the traveling fabric 19. A vacuum box 30 is positioned adjacent to each drum 21, 23, 25, etc., in the dryer drum section 20 where the fabric 19 wraps the drum surface directly with the web traveling on the fabric about the drum. A vacuum box between the pickup vacuum roll 18 which removes the web from press belt 15 and the first drying cylinder 21 will generally be necessary, depending upon actual physical layout of the drying section. None is required here because the first vacuum box 30 has been extended to bear upon transfer roll 18 to exert holding forces on the web.

The suction box 30 is provided with four pressure differential surface zones or suction surfaces 31, 32, 33 and 34. Three of the suction zones 31, 33 and 34 are adjacent the web-supporting fabric 19 as the fabric travels to and from a fabric-wrapped cylinder, for example, cylinder 23 of FIGS. 2 and 3. These suction zones 31, 33 and 34 extend, at least in effect, to create a pressure differential force acting through the fabric 19 to hold the relatively impervious wet web W to the fabric surface, independent of any velocity stresses such as stray air currents or centrifugal forces.

Referring to FIGS. 2 and 3, the suction zone 32, adjacent the portion of the drum 23 not wrapped by the fabric 19 ensures that a pressure differential force holds the fabric 19 and web W to the surface of the drum 23, overcoming centrifugal stresses that are exerted on the web as it travels about the drum.

In a preferred embodiment, each bottom cylinder 21, 23, 25 is provided with a plurality of shallow circumferential grooves cut into the cylinder's outer surface, spaced across the face or length of the drum. These grooves 40 are indicated at the periphery of each lower drum 21, 23, 25. The resulting pressure differential induced in the drum grooves 40 by suction zone 32 holds the fabric-web combination in supporting contact with the drum surface.

Referring to FIG. 3, in a preferred embodiment of the invention, it is desirable to divide the vacuum box 30 internally into relatively high and low pressure differential zones depending upon what forces must be exerted on the web to hold it to its supporting fabric 19. FIG. 3 shows the vacuum box divided into four zones by walls 41 and seals 42, 43. Vacuum zone 32 must operate at a relatively high vacuum in order to hold the web and fabric to the dryer drum 23 as they are subjected to centrifugal stresses during travel about the drum. Vacuum zone 34 must also operate at a relatively high vacuum in order for the zone forces to capture and to hold the web onto the supporting fabric as it departs direct contact with the dryer drum 22. Zones 31 and 33 may be operated at significantly lower vacuum values as they need only keep the web adhered to the fabric as it travels between the dryer drums where otherwise the web would be subjected to speed limiting stray air currents and minor centrifugal forces.

In the prefered vacuum box 30, the divider walls 41 are apertured with adjustable orifices 44 which permit communication between vacuum zones 31, 32, 33 and 34. The orifices 44 are typically adjusted so that evacuating zones 32 and 34 to create a high vacuum in thos zones causes evacuation of zones 31 and 33 at a lower rate. As a result, zones 31 and 33 operate at lower relative vacuum than zones 32 and 34, but sufficient to ensure that the web is held to supporting fabric 19 opposite zones 31 and 33.

The vacuum box suction zones are designed to effectively provide sufficient pressure differential forces acting perpendicular to the major surface of the web to ensure that the web is held onto its supporting fabric 19 regardless of machine environmental conditions, web characteristics or specific fabric or machinery factors which would otherwise operate to cause the web to separate from its supporting fabric. These factors, of course, influence the exact operational shape of box 30. It was discovered experimentally that vacuum zone 34, which initially operates on the web as it leaves direct contact with dryer drum 22 must exert its pressure differential forces on the web-fabric combination significantly prior to the expected line of departure of the web-fabric combination from the drum 22. The zone 34 must operate on the web and fabric sufficiently in advance of the tangent line of departure in order to have sufficient time for the vacuum to remove air from the dryer fabric and establish forces sufficient to hold the web to the fabric.

As a practical matter, a doctor blade may be provided to ensure complete removal of the web from web wrapped cylinders 22, 24 etc. In general, however, the web will travel adhered to the fabric at departure from the web wrapped cylinder as there is a layer of vapor between the hot cylinder surface and the web which prevents the web from adhering to the cylinder surface. This is a very different condition from that existing at the smooth press roll where the web is pressed into adherence with the roll surface and must subsequently be peeled from that surface at departure.

The vacuum zone 31 need only operate from the line of departure of the web from the drum 23 up to direct contact of the web with the next drying drum 24.

A key practical feature of the vacuum box 30 of this invention is that contact between the rapidly moving fabric supporting means and other machine elements is minimized. Fabric wear and damage will inherently occur whenever the web comes into contact with a stationary, rigid surface. The most significant damging conditions occur in typical paper mill arrangements when a wad of paper comes between a fabric and the dryer drum and the resulting bulge contacts a rigid machinery surface. Such contact can destroy the fabric and, of course, cause a machine shut-down.

As a solution to this problem the vacuum box 30 is provided with flexible seals 42 extending across the width of the machine. The seals are made of any resilient flexible material that will cause minimal damage to the fabric if the fabric, traveling at high speed, inadvertently contacts a seal. The seals extend, perpendicular to the fabric surface, as close as practical to the surface of the fabric without bearing against it. The seal 42 bends when a paper wad 100 bulges out fabric 19 in passing about the drum surface 22.

The seals 42 must approach the fabric where the fabric-web combination is in contact with a solid surface, such as a dryer roll. Otherwise, air currents traveling with a moving fabric or roll will penetrate the fabric and lift the web from its supporting means exposing it to velocity stresses.

Seals 43 may be made of more rigid materials since there is no wad damage problem. These seals 43 bear directly on the surface of the drum 23.

Figure 4:
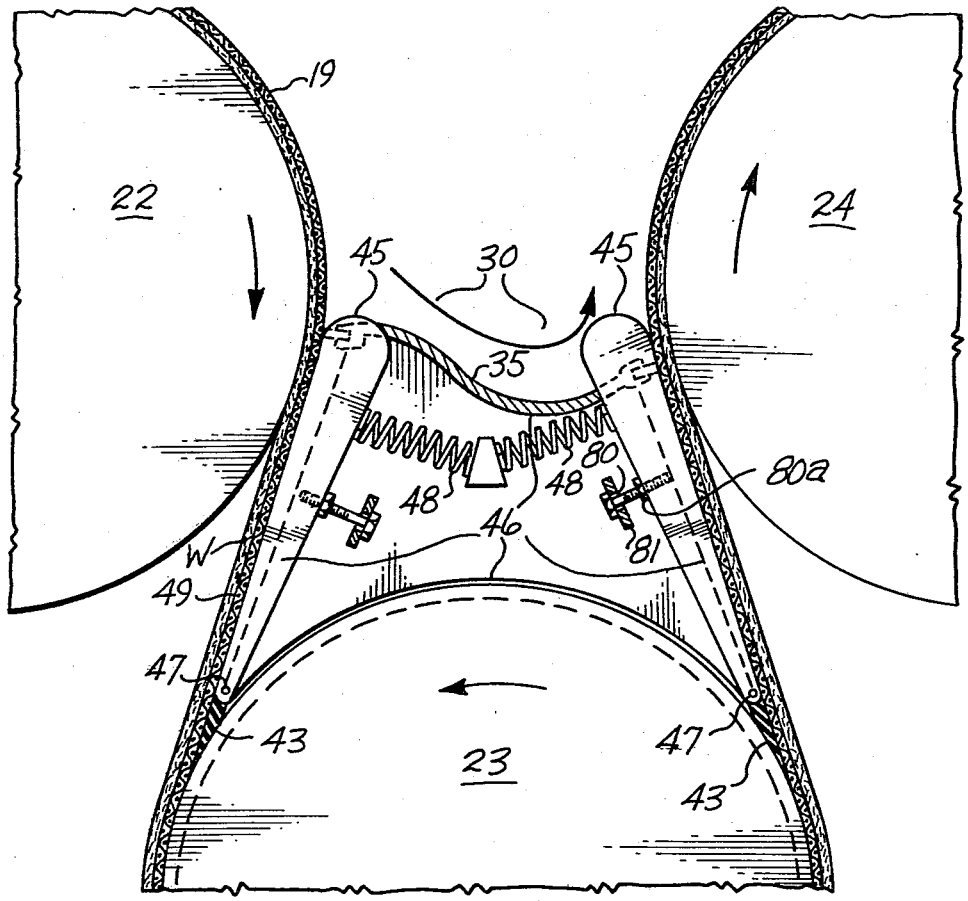
FIG. 4 shows end seals for the vacuum box holding means.

End seals for the vacuum box 30 are shown in FIG. 4. The function of these seals is to preserve the vacuum in the box 30 while accommodating the passage of wads of paper through the system without damage to the fabric or box. The end wall 46 of the vacuum box is dimensioned to conform closely to the adjacent drum 23 where there is no danger of paper waste blockages. The portions of the end wall 46 adjacent the traveling fabric 19 are fitted to allow a generous space between its edges and the traveling fabric to accommodate waste. The end seals 45 are attached to end wall 46 at pivot 47, near adjacent drum 23. At the upper end of the seal 45 springs 48 urge the seal leading edge 49 into close proximity to traveling fabric 19. An adjusting screw 80 attached to the end seal 45 through nut **80*a* and stop 81 fixed to the wall 46 permits adjustment of the clearance between the seal leading edge and the fabric. The leading edge 49** may be contoured to reasonably conform to the path that the fabric-web actually travels between the dryer drums.

A wad of waste paper passing about the drum between the cylinder surface of drum 22 and the fabric forces the end seal 45 to pivot away from its normal position. After the wad passes, the spring 48 urges the seal back into its original position. The wad, upon issuing from between the drying cylinder and fabric, drops clear. Wads are not a problem at the bottom cylinders as the sheet is on the outside of the fabric where it wraps the bottom cylinders.

As noted previously, air currents are created by the moving cylinders and flow adjacent to the moving equipment. In conventional designs, "bulges," wherein the web is slightly separated from its fabric, tend to occur at certain locations, as for example, where the web-fabric combination approaches and departs a drying drum. While static deflectors in the dryer cylinder "pockets" may reduce this problem, the vacuum box design of this invention is more positive and controllable It is advantageous to shape certain portions of the vacuum box 30 to deflect some of the air flow. The top surface 35 of the box 30 is formed into a curved surface to assist in deflecting air from entering the pocket area between the drums. Reduction in the amount of air that enters the pocket area reduces the amount of vacuum required and, hence, energy that must be provided to create the differential pressure necessary to hold the web onto its supporting fabric.

To eliminate the chance of the fiber sheet wrapping an upper cylinder and causing high tensions in the fabric and on the cylinder bearings and gears, a doctor (not shown) is fitted to each upper cylinder.

Cylinders on conventional machines are all typically gear driven. The dryer fabric is strong and can impose heavy, varying loads on the cylinder gears and bearings. To reduce capital costs and these loads, some cylinders may be free running, that is, driven by the fabric 19.

The drying rate of drum dryers is dependent upon the arc of contact or degree of wrap of the paper web about the heat transfer surface of the drum. In the conventional paper machine, where the paper web is unsupported between drums, the actual arc of contact is considerably less than suggested by the geometry of the layout. Air bulges, as noted above, at the approach and departure of the web from the drum tend to separate the web from heat transfer contact with the drum surfaces. The introduction of a supporting means for the web during drying increases the arc of contact at the top cylinders, but results in interposing the fabric between the cylinder and web on the bottom cylinders. The air currents and centrifugal forces operating on the system in this lower drying region tend to separate the web from its fabric where it nears and passes around the bottom cylinders, greatly reducing the drying achieved by the bottom cylinders. Bringman and Jamil, "Engineering Considerations for Lightweight Paper Drying in High Speed Machines," Paper Technology & Industry—UK Vol. 6, pp. 198–200 (July–August 1978). The pressure differential surface zones at suction box surfaces 31, 32, 33 and 34 of the present invention cause the web W to engage in greater contact, with the lower drums 21, 23 and 25, for example, than possible with previous conventional supporting systems. This permits more heat to be transferred to the web through the fabric.

The proximity of the sheet to these lower pressure zones increases the thermodynamic forces driving water vapor from the sheet into the low pressure adjacent areas. The combination of a greater arc of contact on the top cylinders, more effective ontact at the lower cylinders and lower pressures adjacent the sheet in the vacuum boxes and grooved lower cylinders results in drying rates above those obtainable with present conventional or serpentine fabric arrangements. Thus, this invention avoids the solution of Mahoney, which adds extra heat to the lower rolls which is less energy effective. Also, the advantageous solution of this invention is attained without the more complex solution shown in the prior art, for example, Soininen.

An alternative to the circumferential grooves cut into the drying cylinder is to employ a special dryer fabric having longitudinal, with respect to the machine, ridges built into its structure on the side opposite to that carrying the paper web. The spaces between the ridges serve the same function as the grooves in the cylinders. The fabric must be permeable in order for the vacuum to communicate through the fabric and hold the web or sheet to it.

The grooved, heated lower cylinders may, as an alternative, be replaced with cylinders having foraminous major surfaces. For example, the bottom of the grooves 40 of the cylinders may be apertured about their circumference. A vacuum on the cylinder interior then evacuates the grooves thereby holding the web and fabric combination together onto the cylinder outer surface, independent of centrifugal or other velocity stresses. The formainous cylinder may be of relatively light weight construction since it does not have to withstand conventional steam pressures.

In the conventional paper machine, peeling and velocity related stresses result in tensioning or stretching stresses being imparted to a web at many locations in the papermaking operation. A paper web is typically intermittently stressed below its breaking level by being longitudinally stretched or tensioned between drying cylinders, for example. Each paper has a certain limited ability, represented by its breaking length at each point in the processing, to resist these stresses. Each stress is translated into a strain from which the paper does not totally elastically recover. These retained strains are cumulative as each subsequent stress occurs. The amount of inelastic strain that a paper has accumulated during processing determines the remaining extensibility or toughness of the finished sheet.

In the process of this invention, the web, since it is all times supported, does not experience the tensioning stresses that typically exist in transfers and transport through the drying process. The dryer fabric and its holding means ensures that the web is always supported while drying, thus avoiding velocity-related stretching in the dryer section. Thus the paper product at the reel has a retained toughness or stretchability not found in conventionally prepared papers. Improved toughness is beneficial for many paper grades. For example, a tougher newsprint reduces the number of breaks on printing presses. As another example, bag papers are less prone to bursting or tearing.

The ratio of cross to machine direction strength of the web is improved since the web is held onto a supporting fabric at all times. The resultant change in internal strain in the web in the cross direction improves desired properties for some grades, such as liner and medium.

The sheet, as it passes through the drum dryer section, tends to shrink. It is desirable to allow this to occur when the sheet is to retain its stretchability. This retention may be encouraged by dividing the supporting means function in the dryer between a number of supporting fabric means and driving each successive fabric at successively lower speeds. Sometimes it is advantageous to stretch the sheet slightly as it is drying. This sacrifices some stretchability but enhances sheet properties such as stiffness making the sheet less prone to curl. Some stretching or "draw" may be useful in preventing wrinkle defects from developing at transfer of the web from thep ress felt onto the first dryer fabric. This stretching may be controlled by driving the succession of dryer fabrics at speeds differential to those matching the shrinkage rate.

Transfers of the web between drying fabrics are accomplished by methods that ensure positive web support at all times. FIG. 5 illustrates a transfer between a dryer fabric 110 and a subsequent fabric 200.

Transfer is effected by vacuum transfer roll 111 which removes the web W from fabric 110 just as the web-fabric combination leaves the influence of suction box 112. The web adheres to transfer roll 111 which rotates the web into contact with fabric 200. The roll 111 may rotate at any convenient speed to enhance the desired result.

The suction box 113, adjacent fabric 200, then causes the web W to leave suction roll 111 and adhere to fabric 200.

Referring to FIG. 2, an arrangement similar to that of FIG. 5 may be used in the initial transfer of the web from belt 15 by transfer roll 18 onto dryer fabric 19. A speed or velocity differential of roll 18 and fabric 19 with respect to the belt 15 of up to 2.5% (preferably 1–2%) will prevent wrinkles from forming in the paper sheet.

As an alternative to the FIG. 5 arrangement, a transfer between dryer fabrics can be effected using the pressure differential means operating on the web fabric combination during transit between cylinders. FIG. 6 illustrates this scheme.

The web W travels about the dryer drum 23'' supported on the fabric 110'. As the web leaves the drum 23'', fabric 200' is brought into contact with it. The web, now sandwiched between fabrics 110' and 200', travels across suction boxes 112' and 114. The pressure differential between the two suction zones of the boxes is adjusted so that the web transfers from adherence to fabric 110' onto fabric 200'.

Yet another transfer scheme is shown in FIG. 7. The transfer is made from a first dryer fabric 300 to second fabric 301, about dryer cylinder 302. Cylinder 302 is provided with circumferential grooves 303 and is wrapped with a permeable belt or fabric 304. Vacuum box 305 evacuates cylinder grooves 303 only to adhere web W and belt or fabric 304 onto the cylinder as it passes about the cylinder.

Transfer from the first fabric 300 onto belt 304 occurs as previously described, without stress, at point 306 where the influence of vacuum box 308 just ends and the evacuated grooves 303 just begin. A similar transfer occurs at point 307 from belt 304 onto second fabric 301 under the influence of vacuum box 309. Cylinder 302 may rotate at any convenient speed, generally between that of the first and second fabrics 300, 301, that enhances the desired result.

Of course, after the web has attained sufficient strength, through drying, to reliably exist independently of stresses in the machine environment, the web no longer requires a supporting fabric. At that point, which is determined by the inherent strength of the web's furnish, the speed of the machine and web dryness for a given web, the web may continue through the machine unsupported without great risk of breakage. A key feature of this invention is this understanding which permits determining where in the machine the expense and costs of supporting and holding is required. Likewise, it establishes where these costs are not necessary.

Other combinations of suction rolls, vented rolls, solid rolls, felts, belts and fabrics, etc. will be evident to those skilled in the art. Any combination may take advantage of the invention which requires reduction or elimination of peeling or velocity stresses on the web.

EXAMPLE 1: Mill Economics

A review of the economics of the design of the invention depicted in FIG. 2, compared with those of a current, conventional process, shows the advantages of the new design. Here the advantage highlighted is the choice of a furnish containing a reduced amount of the more expensive bleached kraft chemical pulp, typically included to improve wet processing strength of the web.

The following table of costs for a 750-ton-per-day operation for making newsprint shows a $27/ton improvement over conventional technology as a result of reducing the chemical pulp fiber content of a finished newsprint from 15% by weight to 5%. The machine speed remains the same for both the process of the invention and the conventional technology. The reduced chemical pulp furnish results in a weaker sheet during initial drying, but the supporting and holding process of this invention permit it to be processed at the same speed as if it were a stronger sheet or even faster if desired and the machine has the required drying capability. The following table illustrates the savings resulting only from reduced chemical pulp demand.

TABLE

| Relative Costs Per Ton of Newsprint Produced | | | |
|---|---|---|---|
| Costs | Process of the Invention ($/ton) | Conventional Process ($/ton) | Benefit of Invention ($/ton) |
| Power, $0.01/KWN | 57 | 51 | −6 |
| Chemical Pulp @ $450/ton | 22 (5% of furnish) | 67 (15% of furnish) | +45 |
| Chips, TM @ 120/ton | 114 (95% of furnish) | 102 (85% of furnish) | −12 |
| Total | $ 193 | 220 | 27 |

At an operating rate of 750 tons/day, 350 days/year, the savings amount to $7.1 million per year using typical costs of power, chemical pulp and chips.

Alternatively, of course, the speed of the drying section may be increased, the other components of the papermaking process permitting. Every 100 ft./min. (30.5 m/min.) increase in effective speed is equivalent to an increase in production benefit of about $1 million per year for a large size newsprint machine.

Salable newsprint is presently being made from 100% thermomechanical pulp but at low production speeds by today's standards. The fastest newsprint machine today achieves an average operating speed of 3650 ft./min (1122 m/min.) using 38% chemical pulp. The process of this invention should be able to attain 5,000 ft./min (1525 m/min) without the necessity of using substantial amounts of chemical pulps.

A combination of reduced chemical pulp requirement and speed increases has the potential to increase the return of the largest newsprint machines by in excess of $45 million per year at current pulp and energy costs.

EXAMPLE 2: Pilot Machine Trials

The pilot machine comprises a complete one meter wide paper machine using a Sym-Former producing a paper sheet about 600 mm in width. The web is formed and pressed in an arrangement similar to that shown in FIG. 2. The machine is provided with eleven cylinders in the dryer section arranged as shown in FIG. 2. The solid surfaced cylinders are electrically heated rather than conventionally steam heated. The bottom cylinders have grooved surfaces. A vacuum box (not shown in FIG. 2) holds the sheet onto its supporting fabric during transport of the web from the transfer roll (which transfers the web from the press belt onto the dryer fabric) up to where the web is brought into direct wrapping contact with the first heated drying cylinder.

Vacuum boxes similar to that depicted in FIG. 3 occupy the dryer "pockets" as shown in FIG. 2.

The following tables and observations are pilot trial results using various strength furnishes to produce certain typical paper products at varying machine speeds.

Trial A Corrugating Medium

The target paper was corrugating medium at 127 grams per square meter (g/m$^2$) basis weight.

The furnishes tested were 100% hardwood pulp made by a conventional green liquor semichemical pulping process. At 37° C., this pulp furnish had a wet web strength, at 35% solids, of 20 BLM (breaking length, meters). In a second group of trials the hardwood pulp was blended with a strong chemical kraft pulp consisting of a bleached sulphate process pulp made from a long fiber softwood. The furnish containing 80% hardwood and 20% kraft pulp had, at 37° C. and 35% solids, a wet web strength of 40 BLM.

In the corrugating medium trials, the press belt 15 shown in FIG. 2 was used to transport the web from the last nip until transfer by suction roll 18 onto dryer fabric 19. During trials of the process and equipment of this invention a pressure differential was established at vacuum boxes 30, including the additional box operating between the point of transfer of the web onto a supporting dryer fabric and its contact with the first drying cylinder. Referring to FIG. 3, the second suction box in the pilot machine was equipped with vacuum gauges located at points a–d. Table I shows vacuum at points a–d for a drying fabric having a permeability of 500 m$^3$/m$^2$h (at $\Delta P = 100$ Pa).

TABLE I

VACUUM BOX PRESSURES

| Trial | Speed m/s | Pressure Differential (see FIG. 3, Points of Measurement) a | b | c | d | e |
|---|---|---|---|---|---|---|
| Without paper web on machine | 12.5 | 460 | 160 | 210 | 50 | 30 |
| Same as above | 15.0 | 430 | 160 | 180 | 40 | 20 |
| With paper web on machine | 12.5 | 720 | 310 | 400 | 400 | 400 |

A tension was exerted on the fabric to prevent rubbing between the fabric and the vacum boxes. A tension of about 3 kN/m was sufficient when vacuum box pressures were on the order of 500 Pa. At speeds above 15 m/s, suction in the vacuum boxes had to be increased to 700–800 Pa. This vacuum caused some fabric rubbing at the seals until seals were readjusted.

The necessity of using the vacuum boxes was demonstrated by shutting them off during a number of trials. When the boxes were shut down, conditions similar to conventional paper machine environments were quickly established resulting, in general, in sheet breakages. Table II presents the results of these trials at increasing speeds for both the 100% hardwood and 20% kraft furnishes.

TABLE II

CORRUGATING MEDIUM, 127 g/m$^2$

| Furnish (Species mix, wt. %) | Machine Speed (m/s) | Process & Equipment of Invention: Vacuum System Operating | Vacuum System Shut Down |
|---|---|---|---|
| 100% hardwood | 7.5 | Satisfactory Run | Sheet break-machine down |
| 100% hardwood | 10.0 | Satisfactory Run | Sheet break-machine down |
| 100% hardwood | 12.5 | Satisfactory Run | Sheet break-machine down |
| 20% kraft and 80% hardwood | 12.5 | Satisfactory Run | Satisfactory Run[1,2] |
| 20% kraft and 80% hardwood | 15.0 | Satisfactory Run[3] | Sheet break-machine down |

Notes:
[1]Transfer suction roll off.
[2]Sheet separated slightly from fabric on last three bottom cylinders even though draw increased to 2.8%.
[3]Transfer suction roll off.

Transfer of the web from the press belt onto the dryer fabric was generally without difficulty. In some cases is was possible to shut down transfer roll vacuum without adversely affecting transfer. The suction in the vacuum transfer roll ranged from 0 to 100 Pa. If a good transfer off the press belt could be obtained, then no suction was used at the transfer point. At 100 Pa in the box some rubbing of fabric on the box surfaces was experienced.

A slight longitudinal stress or "draw" was exerted on the web at the point of transfer from the press belt. The draw was established by operating the transfer roll and dryer fabric combination at a higher speed than the press belt speed. The amount of draw exerted on the web is expressed as a percentage representing the speed differential between the press and dryer sections. The draw differentials were 0.5–2.3%, and preferably 1–2%. Too low a draw resulted in wrinkle defects in the paper product. Too high a draw resulted in web breaks and machine shutdowns. A 1.5–2% draw was applied, except where noted, in the pilot trials.

In general, runnability was good when the vacuum boxes of the invention were operating. This is indicated in Table II by the "Satisfactory Run" observation. Shut-down of the boxes resulted in the web separating from its supporting fabric at all speeds, leading in all but one case to failure of the sheet. The time between suction shutdown and web breaks was about 0.5–1.0 minute.

Table II demonstrates that weak hardwood furnishes can be run where the paper machine uses the supporting and holding process and equipment of this invention. When the holding systems were shut down, this furnish could not be run at the test speeds. For a 20% kraft furnish, speeds of 15.0 m/s were attained for the process and equipment of the invention. The furnish could be run without the vacuum box holding means operating at 12.5 m/s. However, at this speed the web had separated from its supporting fabric on the last three bottom drying cylinders. The separated web was thus subject to machine velocity stresses and susceptible to breakage should, for example, inherent wet web strength decrease or speed be increased. Increasing machine speed to 15.0 m/s did, in fact, result in web failure when the vacuum holding forces were cut off.

The fastest machine making corrugating medium today operates at a maximum speed of 10.7 m/s (2100 ft./min.) and average 9.9 m/s (1950 ft./min.). These speeds are only attainable when the furnish includes about 30% expensive chemical pulp to improve wet strength. The pilot machine trial results demonstrate a 40% speed increase. A 16.8% speed increase was attained with the furnish from which all chemical pulp had been excluded.

Trial B–Fine Paper

The target paper in this group of pilot machine trials was a fine paper of 74 g/m$^2$, having a filler content of 12%.

The furnishes tested ranged from 100% hardwood to furnishes containing 30% kraft. The hardwood pulp for this trial was a bleached sulphite pulp made from a 1 to 1 mixture of mixed northern dense hardwood and aspen. At 39° C., 35% solids, this pulp has a wet web strength of 39 BLM. The strong chemical pulp used to improve wet web strength of the hardwood furnish for these trials was a bleached sulphate kraft pulp made from a long fiber softwood. A 30% kraft, 70% hardwood furnish has a wet web strength of 59 BLM at 39° C., 35% solids.

In the fine paper trials, the paper machine arrangement was as described above. Vacuum box suctions were increased to 1000–1500 Pa, which caused some rubbing between the fabric and box surfaces. Table III shows how this pressure was distributed in the vacuum box for two different fabric permeabilities.

TABLE III

FINE PAPER TRIAL VACUUM BOX PRESSURES

| Fabric Permeability (m$^3$/m$^2$h, ΔP=100 Pa) | Conditions of Trial | Speed (m/s) | Pressure Differential (See FIG. 3) a | b | c | d | e |
|---|---|---|---|---|---|---|---|
| 100 | without paper web | 12.5 | 1,150 | 12 | 950 | 850 | 650 |
| 100 | with paper web | 12.5 | 1,300 | 96 | 1,220 | 1,310 | 1,420 |
| 500 | without paper web | 15.0 | 510 | 100 | 230 | 40 | 40 |
| 500 | with paper web | 15.0 | 860 | 140 | 510 | 500 | 530 |

A draw of about 1.5–2.0% was used to keep the sheet wrinkle free on the dryer.

Table IV presents the results of pilot trials for the various furnishes at increasing machine speed.

TABLE IV

FINE PAPER, 74 g/m$^2$

| Furnish Species mix, wt. %) | Machine Speed (m/s) | Process & Equipment of Invention: Vacuum System Operating | Vacuum System Shut Down |
|---|---|---|---|
| 100% hardwood | 10 | Satisfactory Run | Satisfactory Run[1] |
| 100% hardwood | 12.5 | Satisfactory Run | Sheet break, machine down |
| 100% hardwood | 15 | Satisfactory Run | Sheet break, machine down |
| 5% kraft 95% hardwood | 10 | Satisfactory Run | Satisfactory Run |
| 5% kraft 95% hardwood | 12.5 | Satisfactory Run | Sheet break, machine down |
| 5% kraft 95% hardwood | 15 | Satisfactory Run | Sheet break, machine down |
| 30% kraft 70% hardwood | 12.5 | Satisfactory Run | Satisfactory Run[2] |
| 30% kraft 70% hardwood | 15 | Satisfactory Run | Sheet break, machine down |
| 30% kraft 70% hardwood | 17.5 | Satisfactory Run | Sheet break, machine down |

Notes:
[1]With increased draw.
[2]Sheet separated slightly from fabric on last three bottom cylinders, even though draw increased.

The fine paper furnishes were somewhat more difficult to transfer from the press belt onto the dryer fabric. A 30 kPA (maximum) suction at the transfer roll was required to affect transfer, in contrast to the corrugating furnishes which could often be transferred without any suction on at the transfer roll at all. A somewhat stronger draw on the paper web, on the order of 2.5%, was sometimes required with the fine furnish.

Dryer section runnability with the fine paper furnish was worse that with the corrugating furnish. There was a strong tendency for the fine paper furnish web to adhere to the drying cylinders because of the characteristics of the pilot machinery. As noted earlier, vacuum box suction had to be increased considerably.

Referring to the Table IV results, the 100% hardwood furnish trials show the greater inherent strength of the furnish. Thus, the furnish would run, without the vacuum boxes exerting holding forces on the web, at 10 m/s. However, when the speed was increased to 12.5 m/s, web breakage was experienced when the vacuum boxes were shut down. With the boxes operating, the web ran satisfactorily at 12.5 m/s and also at 15 m/s (the highest speed attempted). When the vacuum boxes were shut down, the sheet broke at 12.5 m/s.

At this point in the trial the furnish was modified to improve its wet web strength to determine how much kraft chemical pulp would be needed to allow the machine to operate without the vacuum box holding means of the invention. Not until the kraft pulp content had reached 30% was the web able to run at 12.5 m/s without the holding means of the invention. However, when the speed was increased to 15 m/s, the sheet broke when the vacuum boxes were shut down. With the vacuum box holding force operating on the web to hold the web onto its supporting fabric, the web was run satisfactorily at 15 m/s and even at 17.5 m/s.

Trial C—Newsprint 50 g/m$^2$

The objective of this trial was to produce newsprint at 50 g/m$^2$ at high production speeds.

The furnish comprised 44% groundwood pulp, 44% thermomechanical pulp and 12% kraft chemical pulp.

The identical arrangement described above was used in the trials. It was found that the following "draw" was necessary to obtain satisfactory newsprint.

TABLE V

| Speed Difference Between Press Section and Dryer Section: Speed m/s | Speed Difference at Transfer Point |
|---|---|
| 15.0 | 1.5 ± 0.5% |
| 17.5 | 2.0 ± 0.5% |
| 20.0 | 2.6 ± 0.6% |

The highest speed attainable, where the sheet could be reliably produced was, 20 m/s (3937 ft/min). Speeds of 22 m/s/(4331 ft/min) could occasionally be established but tended to break at transfer from the press to the dryer section. The speed improvement over conventional speeds was limited by the lack of suitability of the press belt (FIG. 2, element 15) for effecting a relatively tensionless transfer of the newsprint furnish used into the dryer section.

In sum, the pilot trial results demonstrate the operation of the processes and equipment of the invention. The results show that the invention operates largely independent of the inherent strength of the furnish being processed. The trial results show that this advantage is in distinct contrast to prior art processes, represented by trials in which the vacuum box holding forces were shut off.

The speed increasing benefits of the process and equipment of the invention were likewise demonstrated by the pilot trials. The upper limits of the speed improvements contemplated were not attained in these trials because of equipment limitations described above. The speed improvements contemplated are limited only by process and equipment limitations that are unrelated to velocity stresses.

The improvement of this invention may also be translated into several other productivity advantages. For example, the capital cost for a new machine may be reduced for a given capacity since all elements of the machine might be reduced in width because of the higher production speed of the new machine. The advantages of this invention are readily retrofitted onto existing conventional paper machines.

What is claimed is:

1. In a papermaking process of the type wherein a paper web is dewatered by passage through a press nip and dried by a series of heated cylinders, the improvement, wherein velocity and other paper machine related stresses that typically operate on the web to limit production speed are substantially eliminated, comprising:

transporting said web on supporting means from the press nip through a series of heated cylinders;

drying said web by contacting it directly and indirectly with said series of heated cylinders; and holding said web onto its supporting means by employing forces normal to the major web surfaces sufficient to overcome velocity-related stresses on all portions of the web during said transportings, at least until said web has attained sufficient strength through drying to be self-supporting at the speed selected.

2. The process of claim 1 wherein:

a portion of said holding force is created by a pressure differential forcing said web against said supporting means.

3. The process of claim 1 wherein:

a portion of said holding force is created by applying a differential pressure to the web sufficient to hold the web onto the fabric supporting means along substantially the entire length of travel of the web between adjacent dryer cylinders in the first portion of the dryer series.

4. A paper drying process for controlling the amount of shrinkage permitted in a paper web in the drying section to preserve stretchability and improve curl resistance, comprising:

partially drying said web on a first group of drying cylinders, said web supported on a first supporting fabric and held on to said fabric by pressure differential means exerting forces normal to the major surfaces of said web as the web travels on its suporting fabric from dryer cylinder to cylinder and about said cylinders;

continuing drying said web on a second group of drying cylinders, said web supported on a second supporting fabric and held onto said fabric by pressure differential means as detailed in the above step, said second group of drying cylinders operating at a rotational peripheral velocity less than that of said first group of drying cylinders, said speed being selected to attain desired shrinkage and stiffness; and transferring said web from said first fabric of said first group of drying cylinders to said second fabric of said second group of drying cylinders by employing pressure differential means acting on said web normal to its major surfaces to effect transfer without subjecting said web to peeling or velocity stresses.

5. The process of claim 4 wherein said transferring step, comprises:

converging said web, supported on said first fabric and subject to a pressure differential means holding said web onto its supporting fabric, into contact with a transfer cylinder having a transfer pressure differential surface means wherein said transfer surface exerts a force normal to the major surfaces of said web effecting a transfer of said web onto said transfer surface;

transporting said web adhered to said transfer surface into contact with said second supporting dryer fabric, said second fabric subject to a second pressure differential means; and, transferring said web from said transfer cylinder pressure differential surface onto said second dryer fabric wherein said transferring step is effected by said second fabric differential means exerting normal forces on said web major surfaces.

6. The process of claim 4 wherein said transferring step comprises:

converging said web, supported on said first fabric and subject to a first pressure differential means holding said web onto its supporting fabric, into contact with said second supporting fabric subject to a second pressure differential means, said web being momentarily sandwiched between said first and second fabrics, and said second differential means exerting a normal force on the major surfaces of said web sufficient to result in transferring said web from said first fabric into adhering contact with said second fabric.

7. The process of claim 4 wherein said transferring step, comprises:

converging said web, supported on said first fabric and subject to a first pressure differential means holding said web to said first fabric, into contact with a transfer fabric which wraps a transfer cylinder having a pressure differential surface means, said transfer cylinder pressure differential means exerting a force normal to the major web surfaces sufficient to effect transferring said web from said first fabric onto said transfer fabric;

diverging said first fabric away from said web wherein said web remains adhered to said transfer fabric under the influence of said transfer cylinder pressure differential means;

transporting said web, adhered to said transfer cylinder fabric, into contact with said second supporting fabric, with said web momentarily sandwiched between said transfer fabric and said second fabric, wherein said second fabric is subject to a second pressure differential means;

transferring said web from said transfer fabric onto said second fabric and holding said web on said second fabric for continuing through said drying steps wherein said transferring and holding steps are effected by said second pressure differential means exerting normal forces on the major surfaces of said web; and diverging said transfer fabric away from said web and said second fabric.

8. A paper machine for controlling the amount of shrinkage permitted in a paper web in a dryer section to balance stretchability and stiffness, comprising:

a first group of dryer cylinders for partially drying said web wrapped by a first dryer fabric for receiving said web and transporting the web in supporting contact about said first group of dryer cylinders, said first fabric subject to pressure differential means for holding said web onto its supporting fabric by employing forces normal to the major web surfaces sufficient to overcome velocity-related stresses on all portions of the web;

a second group of dryer cylinders for continuing the drying of said web, operating at a lower peripheral speed than said first group of dryer cylinders, said second group having a second dryer fabric means and pressure differential holding means similar in function and operation to said first group; and a transfer means for transferring said web from said first fabric of said first group of drying cylinders to said second fabric of said second group of drying cylinders, said transfer means comprising pressure differential means for acting on said web normal to its major surfaces to effect transfer without subjecting said web to peeling or velocity stresses.

9. The paper machine of claim 8, wherein said transfer means, comprises:

a transfer cylinder having pressure differential surface means, said transfer cylinder arranged so that said web supported on said first fabric and subject to a first pressure differential means holding said web onto its supporting fabric, converges into contact with said transfer cylinder pressure differential surfaces, said transfer cylinder surfaces exerting a force normal to the major surfaces of said web sufficient to effect transfer from the first fabric onto said transfer cylinder surfaces, said transfer cylinder, on rotation, transporting said web into contact with said second supporting fabric subject to a second pressure differential means which exerts normal forces on said web sufficient to transfer said web from said transfer cylinder pressure differential surface onto said second dryer fabric.

10. The paper machine of claim 8, wherein said transfer means, comprises:

an arrangement wherein said web is momentarily sandwiched between said first fabric, as it leaves the last cylinder of said first group of drying cylinders and is subject to a first pressure differential means for holding said web to said fabric, and said second fabric, as said second fabric approaches the first cylinder of said second group of drying cylinders, subject to a second pressure differential means for holding said web to said fabric, wherein said second pressure differential means exerts a normal force on the major surfaces of said web sufficient to effect transfer from supporting contact with said first fabric into supporting contact with said second fabric for continuation through the drying process.

11. The paper machine of claim 8, said transfer means, comprising:

a transfer cylinder having a pressure differential means operating at its peripheral surfaces;

a transfer fabric wrapping said transfer cylinder arranged wherein the web, supported on said first fabric wrapping said first group of drying cylinders, is converged into contact with the transfer fabric with the web momentarily sandwiched between the two fabrics, said transfer cylinder pressure differential surfaces exerting a normal force on the major surfaces of said web sufficient to effect transfer from the first fabric onto the transfer fabric, said first fabric thereafter diverging away from said web and transfer fabric, said transfer cylinder and transfer fabric arranged to converge said web into contact with said second fabric of said second group of drying cylinders with said web momentarily sandwiched between said transfer fabric and said second drying fabric as said second drying fabric comes into the influence of said second pressure differential means wherein said second pressure differential means exerts a normal force on said web sufficient to effect transfer of said web from supporting contact with the transfer fabric into supporting contact with said second fabric, said transfer fabric arranged to diverge thereafter from said web, said web now adhered to said second fabric for continuing through the drying process.

12. A process for optimizing paper machine dryer section performance, including reducing power requirements, for a paper machine wherein a paper web is transported on a supporting means from a last press nip through at least a first portion of a series of heated drying cylinders and said web is held to said supporting means by employing, in part, vacuum box means for exerting pressure differential forces normal to the major web surfaces sufficient to overcome velocity-related stresses on all portions of the web during said transporting, said optimizing steps, comprising:

measuring the wet web strength of said paper web at intervals along the machine at the local web temperature and dryness at each interval;

calculating velocity stress for a desired machine speed at said intervals along the machine at the web dryness found at each interval;

comparing the velocity stress value at each interval along the machine with the corresponding measured wet web strength; and shutting down all vacuum boxes in the paper machine beyond that point in the drying process where velocity stress is less than the measured strength, wherein the paper web is thus strong enough through increased dryness, to be self-supporting and independent of machine velocity stresses.

13. In a paper machine of the type having a press nip to dewater a wet paper web followed by a series of heated dryer cylinders to dry the wet paper web, the improvement, wherein breaking stresses on the web are substantially reduced, permitting machine speeds significantly in excess of prior known speeds for a given paper grade, comprising:

supporting means for directly receiving said wet paper web from said press nip and transporting the web in partial wrapping direct and indirect contact with each of the heated dryer cylinders, said fabric extending throughout the dryer series; and means for applying forces normal to the major web surfaces for holding all portions of the wet web to the fabric in supporting contact therewith, at least until the web has attained, through increased dryness, sufficient strength to be self-supporting.

14. The paper machine of claim 13 wherein said drying cylinders are arranged in a series and said fabric travels from one cylinder to the next carrying the wet web, sequentially:

(a) into direct wrapping contact with a heated cylinder;

(b) between the heated cylinder to a next following heated cylinder;

(c) into indirect wrapping contact with said following cylinder, with the fabric in direct wrapping contact with the surface of said following cylinder; and (d) between said following cylinder and a next heated cylinder of said series.

15. The paper machine of claim 13 wherein said holding means comprises:

a plurality of pressure differential means defining a series of surface zones adjacent to the path of the fabric with said zones extending, adjacent to the fabric, substantially along the path of the fabric that is not in direct or indirect wrapping contact with a dryer cylinder; and means for causing a differential pressure between said fabric and said pressure differential zones to force the web against the fabric.

* * * * *

US004359827B1

REEXAMINATION CERTIFICATE (2252nd)

United States Patent [19]

Thomas

[11] B1 4,359,827

[45] Certificate Issued Mar. 29, 1994

[54] HIGH SPEED PAPER DRYING

[76] Inventor: Keith V. Thomas, 29856 Marine View Dr. SW., Federal Way, Wash. 98032

Reexamination Request:
No. 90/002,994, Mar. 2, 1993

Reexamination Certificate for:

| | |
|---|---|
| Patent No.: | **4,359,827** |
| Issued: | **Feb. 17, 1981** |
| Appl. No.: | **234,288** |
| Filed: | **Nov. 23, 1982** |

Related U.S. Application Data

[63] Continuation-in-part of Ser. No. 91,684, Nov. 5, 1979, abandoned.

[51] Int. Cl.[5] ..... F26B 3/24

[52] U.S. Cl. ..... 34/16; 34/23; 34/114; 34/116

[58] Field of Search ..... 34/15, 16, 23, 41, 54, 34/114, 115, 116, 117, 122, 123; 68/5 C, 5 D, 5 E

[56] References Cited

U.S. PATENT DOCUMENTS

| | | | |
|---|---|---|---|
| 3,250,019 | 5/1966 | Beachler | 34/117 |
| 3,370,359 | 2/1968 | Beachler | 34/18 |
| 3,503,139 | 3/1970 | Mahoney | 34/111 |
| 3,816,941 | 6/1974 | Holik et al. | 34/116 |
| 3,874,997 | 4/1975 | Kankaanpaa | 162/290 |
| 4,359,827 | 11/1982 | Thomas | 34/16 |

*Primary Examiner*—Denise L. F. Gromada

[57] ABSTRACT

An improved paper drying process and machine are described in which the paper web is supported independently of velocity-induced stresses thus permitting operation at speeds significantly in excess of the prior art for each paper grade. The process requires: (1) transporting the web on a supporting fabric that travels from the last press nip through at least the initial portion of a drying section; and (2) holding the web onto its supporting fabric by employing forces normal to the major web surfaces sufficient to overcome those forces which tend to lift the web from its supporting fabric. The web on its supporting fabric travels a serpentine path through the drying section about drying cylinders with the web alternating between direct contact with a drying cylinder followed by indirect contact with the subsequent cylinder. The principal holding forces are preferably pressure differentials created by vacuum boxes arranged to effectively hold the web to its supporting fabric on all portions of the web-fabric combination where the web is not in direct wrapping contact with the drying cylinders. The fabric supports the web at least until the web has attained sufficient strength through increased dryness to resist breaking stresses at the selected machine speed. The products made by the process of this invention possess a unique toughness or stretchability not found in conventionally prepared papers that have been strained or stretched during manufacture. Processes and machine arrangements designed to balance stretchability with certain desirable stiffness properties are disclosed. Pulp furnishes may now be selected for their contribution to product qualities, such as higher finished product tensile strength, rather than principally for wet strength. For example, chemical pulps may be significantly reduced or eliminated from newsprint furnishes where their purpose has been principally to permit economic paper machine speeds. The invention makes attainable speeds approaching twice current operating levels for each paper grade.

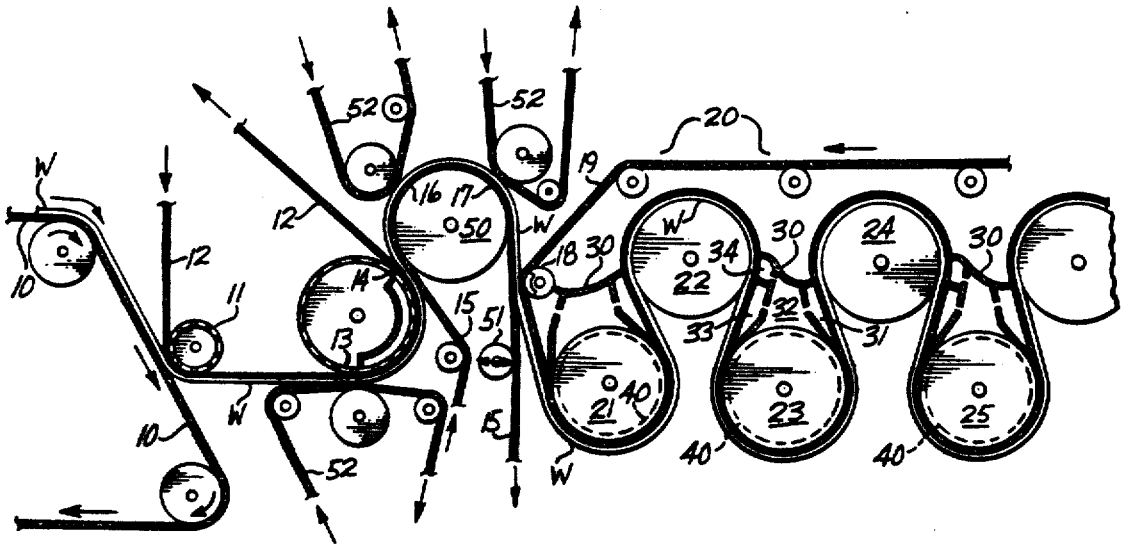

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 15, lines 20–27:

The Web travels about the dryer drum 23" supported on the fabric 110'. As the Web leaves the drum 23", fabric 200' is brought into contact with it. The Web, now sandwiched between fabrics 110' and 200', travels across suction boxes 112' and 114. The pressure differential between the two suction zones of the boxes is adjusted so that the Web transfers from adherence to the fabric 110' and to fabric 200'. *An arrangement such as shown in FIG. 6 wherein the web W is at all times in contact with one or the other of the fabrics 110' and 200' during transfer of the web between the dryer fabrics is referred to in the papermaking art as a web transfer that is effected without open draw.*

AS A RESULT OF REEXAMINATION, IT HAS BEEN DETERMINED THAT:

The patentability of claims 4, 7, 12–15 is confirmed.

Claims 1, 5, 6, 8, 11 are determined to be patentable as amended.

Claims 2, 3, 9, 10 dependent on an amended claim, are determined to be patentable.

New claims 16–22 are added and determined to be patentable.

1. In a papermaking process of the type wherein a paper web is dewatered by passage through a press nip and dried by a series of heated cylinders, the improvement, wherein velocity and other paper machine related stresses that typically operate on the web to limit production speed are substantially eliminated, comprising:

transporting said web on supporting means for the press nip through a series of heated cylinders;

drying said web by contacting it directly and indirectly with said series of heated cylinders; [and]

holding said web onto its supporting means by employing *vacuum holding* forces normal to the major web surfaces sufficient to overcome velocity-related stresses on all portions of the web during said transportings, at least until said web has attained sufficient strength through drying to be self-supporting at the speed selected[.] *; and*

*applying said vacuum holding forces along at least a first zone and a second zone associated with said web, said holding forces applied at said first zone having a magnitude greater than said holding forces applied at said second zone.*

5. The process of claim 4 wherein said transferring step, comprises:

converging said web supported on said first fabric and subject to a *first* pressure differential means holding said web onto its supporting fabric, into contact with a transfer cylinder having a transfer pressure differential surface means wherein said transfer surface exerts a force normal to the major surfaces of said web effecting a transfer of said web onto said transfer surface;

transporting said web adhered to said transfer surface into contact with said second supporting dryer fabric, said second fabric subject to a second pressure differential means; and, transferring said web from said transfer cylinder pressure differential surface onto said second dryer fabric wherein said transferring step is effected by said second [fabric] *pressure* differential means exerting normal forces on said web major surfaces.

6. The process of claim 4 wherein said transferring steps comprises:

converging said web, supported on said first fabric and subject to a first pressure differential means holding said web onto its supporting fabric, into contact with said second supporting fabric subject to a second pressure differential means, said web being momentarily sandwiched between said first and second fabrics, and said second *pressure* differential means exerting a normal force on the major surfaces of said web sufficient to result in transferring said web from said first fabric into adhering contact with said second fabric.

8. A paper machine for controlling the amount of shrinkage permitted in a paper web in a dryer section to balance stretchability and stiffness, comprising:

a first group of dryer cylinders for partially drying said web wrapped by a first dryer fabric for receiving said web and transporting the web in supporting contact about said first group of dryer cylinders, said first fabric subject to pressure differential means for holding said web onto its supporting fabric *surface* by employing forces normal to the major [web] surfaces *of the web* sufficient to overcome velocity-related stresses on all portions of the web;

a second group of dryer cylinders for continuing the drying of said web, operating at a lower peripheral speed than said first group of dryer cylinders, said second group having a second dryer fabric [means] and pressure differential holding means similar in function and operation to said first group; and a transfer means for transferring said web from said first fabric of said first group of drying cylinders to said second fabric of said second group of drying cylinders, said transfer means comprising pressure differential means for acting on said web normal to its major surfaces to effect transfer without subjecting said web to peeling or velocity stresses.

11. The paper machine of claim 8, said transfer means, comprising:

a transfer cylinder having a *first* pressure differential means operating at its peripheral surfaces;

a transfer fabric wrapping said transfer cylinder arranged wherein the web, supported on said first fabric wrapping said first group of drying cylinders, is converged into contact with the transfer fabric and with web momentarily sandwiched between the two fabrics, said [transfer cylinder] *first* pressure differential [surfaces] *means* exerting a normal force on the major surfaces of said web sufficient to effect transfer from the first fabric onto the transfer fabric, said first fabric thereafter diverging away from said web and transfer fabric, said transfer cylinder and transfer fabric arranged to converge said web into contact with said second fabric of said second group of drying cylinders with said web momentarily sandwiched between said transfer fabric and said second drying fabric as said second drying fabric comes into the influence of [said] *a* second pressure differential means wherein said second pressure differential means exerts a normal force on said web sufficient to effect transfer of said web from supporting contact with the transfer fabric into supporting contact with said second fabric, said transfer fabric arranged to diverge thereafter from said web, said web now adhered to said second fabric for continuing through the drying process.

*16. The process of claim 1, said first zone being defined as locations in the paper machine where the web is subjected to centrifugal stresses.*

*17. A paper drying process for controlling the amount of shrinkage permitted in a paper web in the drying section to preserve stretchability and improve curl resistance, comprising:*

*partially drying said web on a first group of drying cylinders, said web supported on a first supporting fabric and held onto said fabric by pressure differential means exerting forces normal to the major surfaces of said web as the web travels on its supporting fabric from dryer cylinder to cylinder and about said cylinders, said web being supported on said first supporting fabric so that a first side of said web directly contacts said first group of drying cylinders;*

*continuing drying said web on a second group of drying cylinders, said web supported on a second supporting fabric and held onto said fabric by pressure differential means as detailed in the above step, said web being supported on said second supporting fabric so that a second side of said web directly contacts said second group of drying cylinders,*

*said second group of drying cylinders operating at a rotational peripheral velocity less than that of said first group of drying cylinders, said speed being selected to attain desired shrinkage and stiffness; and*

*transferring said web from said first fabric of said first group of drying cylinders to said second fabric of said second group of drying cylinders by employing pressure differential means acting on said web normal to its major surfaces to effect transfer without subjecting said web to peeling or velocity stresses.*

*18. The process of claim 17, including transferring said web from said first fabric to said second fabric without open draw.*

*19. The process of claim 17, including maintaining the web sandwiched between said first fabric and said second fabric while said web is being transferred between said first group and said second group of drying cylinders.*

*20. A paper machine for controlling the amount of shrinkage permitted in a paper web in a dryer section to balance stretchability and stiffness, comprising:*

*a first group of dryer cylinders for partially drying said web wrapped by a first dryer fabric for receiving said web and transporting the web in supporting contact about said first group of dryer cylinders, said first fabric subject to pressure differential means for holding said web onto its supporting fabric surface by employing forces normal to the major surfaces of the web sufficient to overcome velocity-related stresses on all portions of the web, said first group of dryer cylinders directly contacting a first side of said web;*

*a second group of dryer cylinders for continuing the drying of said web, operating at a lower peripheral speed than said first group of dryer cylinders, said second group having a second dryer fabric and pressure differential holding means similar in function and operation to said first group, said second group of dryer cylinders directly contacting a second side of said web; and*

*a transfer means for transferring said web from said first fabric of said first group of drying cylinders to said second fabric of said second group of drying cylinders, said transfer means comprising pressure differential means for acting on said web normal to its major surfaces to effect transfer without subjecting said web to peeling or velocity stresses.*

*21. The paper machine of claim 20, said transfer means being effective for transferring said web from said first fabric to said second fabric without open draw.*

*22. The paper making machine of claim 20, wherein the first and second fabrics are disposed so that the web is sandwiched therebetween while being transferred between said first and second groups of dryers.*

* * * * *